US008736543B2

(12) United States Patent
Kubota et al.

(10) Patent No.: US 8,736,543 B2
(45) Date of Patent: May 27, 2014

(54) LIQUID CRYSTAL DISPLAY DEVICE WITH BACKLIGHT

(75) Inventors: Hidenao Kubota, Yokohama (JP); Yasutaka Tsuru, Yokohama (JP)

(73) Assignee: Hitachi Consumer Electronics Co., Ltd., Tokyo (JP)

( * ) Notice: Subject to any disclaimer, the term of this patent is extended or adjusted under 35 U.S.C. 154(b) by 440 days.

(21) Appl. No.: 13/093,667

(22) Filed: Apr. 25, 2011

(65) Prior Publication Data

US 2011/0292018 A1 Dec. 1, 2011

(30) Foreign Application Priority Data

May 28, 2010 (JP) ..... 2010-122957

(51) Int. Cl.
*G09G 3/36* (2006.01)

(52) U.S. Cl.
USPC ..... 345/102

(58) Field of Classification Search
USPC ..... 345/102
See application file for complete search history.

(56) References Cited

U.S. PATENT DOCUMENTS

2005/0184952 A1* 8/2005 Konno et al. ..... 345/102
2005/0231978 A1 10/2005 Kvenvold et al.
2005/0237292 A1* 10/2005 Kim et al. ..... 345/102
2006/0119613 A1* 6/2006 Kerofsky ..... 345/590
2006/0164379 A1* 7/2006 Oh et al. ..... 345/102
2006/0208999 A1* 9/2006 Lee et al. ..... 345/102
2006/0238487 A1* 10/2006 Shih ..... 345/102
2006/0262111 A1* 11/2006 Kerofsky ..... 345/211
2006/0279522 A1* 12/2006 Kurihara ..... 345/102
2007/0002000 A1* 1/2007 Kwon ..... 345/102
2007/0296689 A1* 12/2007 Kimura et al. ..... 345/102
2008/0007512 A1 1/2008 Honbo
2008/0117162 A1* 5/2008 Song et al. ..... 345/102
2008/0150878 A1* 6/2008 Kang ..... 345/102
2008/0150879 A1* 6/2008 Kang ..... 345/102
2008/0186272 A1* 8/2008 Huang et al. ..... 345/102

(Continued)

FOREIGN PATENT DOCUMENTS

EP 2 383 722 A2 11/2011
JP 2008-15430 A 1/2008

(Continued)

OTHER PUBLICATIONS

Extended European Search Report issued Feb. 3, 2012, in European Patent Application No. 11163503.3.

(Continued)

*Primary Examiner* — Adam J Snyder
(74) *Attorney, Agent, or Firm* — Miles & Stockbridge P.C.

(57) ABSTRACT

An area control section individually sets illumination intensity (light control value) of each backlight cell corresponding to each area of the display screen. A spatial filter corrects the light control values so that spatial distribution of the light control values becomes more moderate between adjoining areas. A black area control section sets the minimum value of the light control value based on a "black area" in the screen. A power control section corrects the light control values so that power consumption of the backlight does not exceed a limit value. A shading control section corrects the light control values to relatively lower brightness in the peripheral part of the screen compared to the central part of the screen. A micro-controller switches the operations of the above light control value correcting sections according to an image display mode selected by the user.

5 Claims, 8 Drawing Sheets

(56) References Cited

U.S. PATENT DOCUMENTS

| | | | | |
|---|---|---|---|---|
| 2008/0252666 | A1* | 10/2008 | Chen et al. | 345/87 |
| 2008/0278432 | A1 | 11/2008 | Ohshima | |
| 2008/0297464 | A1* | 12/2008 | Ito | 345/102 |
| 2009/0122087 | A1* | 5/2009 | Maruyama et al. | 345/102 |
| 2009/0140665 | A1 | 6/2009 | Park | |
| 2009/0179849 | A1* | 7/2009 | Wu et al. | 345/102 |
| 2009/0267890 | A1* | 10/2009 | Park et al. | 345/102 |
| 2009/0267926 | A1* | 10/2009 | Seo et al. | 345/102 |
| 2009/0290091 | A1 | 11/2009 | Tsuchida et al. | |
| 2009/0303170 | A1 | 12/2009 | Chung et al. | |
| 2010/0020005 | A1* | 1/2010 | Jung et al. | 345/102 |
| 2010/0073276 | A1* | 3/2010 | Koike et al. | 345/102 |
| 2010/0214209 | A1* | 8/2010 | Seo et al. | 345/102 |
| 2010/0220048 | A1* | 9/2010 | Yamamura et al. | 345/102 |
| 2011/0157262 | A1 | 6/2011 | Fujiwara et al. | |

FOREIGN PATENT DOCUMENTS

| | | | |
|---|---|---|---|
| JP | 2009-42652 | | 2/2009 |
| JP | 2009-139910 | A | 6/2009 |
| JP | 2009-198530 | | 9/2009 |
| JP | 2009-294637 | A | 12/2009 |
| JP | 2010-044194 | A | 2/2010 |
| JP | 2010-79236 | A | 4/2010 |
| WO | WO 2009/101727 | A1 | 8/2009 |
| WO | WO 2010/041504 | A1 | 4/2010 |

OTHER PUBLICATIONS

Japanese Office Action for related Japanese Patent Application No. 2010-122957, dated Aug. 6, 2013 (partial English translation provided).

* cited by examiner

FIG. 5

| BACKLIGHT CONTROL FUNCTIONS / IMAGE DISPLAY MODE | (1) SPATIAL FILTER CONTROL | (2) BLACK AREA CONTROL | | (3) POWER CONTROL | (4) SHADING CONTROL |
|---|---|---|---|---|---|
| | HIGH, MIDDLE OR LOW | ON OR OFF BLACK AREA THRESHOLD VALUE WHEN ON | | ON OR OFF ELECTRIC POWER LIMIT VALUE WHEN ON (90%, 75%) | ON OR OFF POWER REDUCTION VALUE WHEN ON (95%, 90%) |
| | | BLACK AREA: SMALL | BLACK AREA: LARGE | | |
| HIGH | | OFF | | OFF | OFF |
| (MIDDLE) | | | | | |
| LOW | | ON | | ON | ON |
| (a) IN-STORE DEMONSTRATION (SUPERMARKET) | LOW | ON | | OFF | OFF OR ON (INCREASE POWER WHEN ON) |
| (b) POWER REDUCTION (STANDARD) | LOW | OFF | | ON | ON |
| (c) HIGH IMAGE QUALITY (CINEMA) | HIGH OR MIDDLE | ON | | OFF | OFF |

600a

600b

600c

SPATIAL FILTER: STRONG

600d

SPATIAL FILTER: WEAK

LIQUID CRYSTAL DISPLAY DEVICE WITH BACKLIGHT

CLAIM OF PRIORITY

The present application claims priority from Japanese patent application serial No. JP 2010-122957, filed on May 28, 2010, the content of which is hereby incorporated by reference into this application.

BACKGROUND OF THE INVENTION

1. Field of the Invention

The present invention relates to a liquid crystal display device which includes a backlight for illuminating a liquid crystal panel (for displaying images) from behind and executes brightness adjustment of the backlight according to an image signal inputted for the displaying of the images.

2. Description of the Related Art

A liquid crystal display device is equipped with a non-emitting liquid crystal panel (light-transmissive optical modulation element) and a backlight arranged behind the liquid crystal panel to illuminate the panel with light, differently from self-emission display devices (CRT, plasma display panel, etc.). In general, the liquid crystal display device displays images at desired brightness by controlling the optical transmittance of the liquid crystal panel according to the brightness specified by the image signal while making the backlight emit light at a fixed brightness level irrespective of the image signal. Therefore, the electric power consumption of the backlight remains constant without decreasing even when dark images are displayed. This leads to low electric power efficiency of the liquid crystal display device. A technique proposed as a countermeasure against this problem employs variable brightness of the backlight. The technique reduces the electric power consumption while improving the image quality, by controlling the grayscale level of the liquid crystal panel and the brightness of the backlight according to the brightness level (luminance level) of the inputted image signal. There also exists a technique known as "area control" or "local dimming", in which the backlight is segmented into multiple areas and the backlight brightness control is conducted for each of the areas.

For example, in a liquid crystal display device described in the first embodiment of JP-A-2008-15430, the backlight is segmented into a plurality of areas, the brightest grayscale level in each area in one frame of the inputted image signal is detected in regard to each primary color (R, G, B), and the grayscale levels of the inputted image signal are converted (adjusted) so that the brightest grayscale level equals the upper limit of the grayscale level, while making the backlight blink (at a high frequency) at a duty ratio corresponding to the ratio of the detected brightest grayscale level to the upper limit of the grayscale level during the lighting period of the backlight.

SUMMARY OF THE INVENTION

The aforementioned area control is capable of minimizing the power consumption of the entire backlight since the power consumption can be optimized for each of the areas. However, the execution of the area control can cause deterioration in the image quality depending on the pattern, design, etc. of the screen (i.e., image displayed on the screen). For example, in a screen in which a small black area (black window area) exists in a white background, the electric power reduction effect is small since the number of areas undergoing the reduction of the backlight brightness is small. Further, a drop in the brightness of a white background area surrounding the black window area becomes pronounced since the light originally leaking from the black window area to the surrounding white background area disappears almost totally. Therefore, it is desirable that the area control be carried out properly according to a "black area" (i.e., the area (size) of black areas (black parts) on the screen.

Other effects of the backlight control include, for example, prevention of leaking of light between adjoining areas with the use of a spatial filter, reduction of electric power (power consumption) by power control, improvement of visual qualities by shading control, etc.

Optimum conditions for the quality improvement of the displayed image and the power reduction of the backlight vary depending also on the viewing environment and the image display mode. For storefront or in-store demonstration, for example, high brightness and high image quality should be given priority over power reduction since the illuminance of the surrounding environment is high. In contrast, power reduction should basically be given high priority for viewing at home. Even for home viewing, however, high image quality is desirable for watching movies, etc.

It is therefore an object of the present invention to provide a liquid crystal display device capable of optimally setting the backlight control according to the viewing environment and the image display mode.

In accordance with an aspect of the present invention, there is provided a liquid crystal display device comprising a liquid crystal panel and a backlight which illuminates the liquid crystal panel with light, wherein the liquid crystal panel is segmented into a plurality of areas of pixels by dividing the pixels on the panel into a plurality of pixel groups, and the backlight is formed by a plurality of backlight cells corresponding to the areas, respectively. The liquid crystal display device comprises: an area control section which sets a light control value, as a value for individually controlling illumination intensity of each backlight cell, based on a brightness level of an image signal for the area corresponding to the backlight cell; light control value correcting sections which corrects the light control values set by the area control section; and a controller which controls operations of the area control section and the light control value correcting sections. The controller controls the illumination by the backlight by switching the operations of the light control value correcting sections according to an image display mode selected by a user.

Preferably, the light control value correcting sections include at least two selected from the following: a spatial filter which corrects the light control values so that spatial distribution of the light control values becomes more moderate in consideration of effect of leaking of light between adjoining areas; a black area control section which measures a black area based on the number of pixels whose brightness signal level is a black level threshold value or less, compares the calculated black area with a black area threshold value, and sets a minimum value of the light control value based on result of the comparison; a power control section which calculates power consumption of the backlight and corrects the light control values so that the power consumption does not exceed an electric power limit value; and a shading control section which corrects the light control values so as to relatively lower brightness in a peripheral part of a screen of the liquid crystal panel in comparison with a central part of the screen.

By the present invention, a liquid crystal display device capable of optimally setting the backlight control according to the viewing environment and the image display mode can be provided.

BRIEF DESCRIPTION OF THE DRAWINGS

These and other features, objects and advantages of the present invention will become more apparent from the following description when taken in conjunction with the accompanying drawings wherein:

FIG. 5 is a table showing the relationship between image display modes and the backlight control.

DESCRIPTION OF THE PREFERRED EMBODIMENTS

Figure 1:
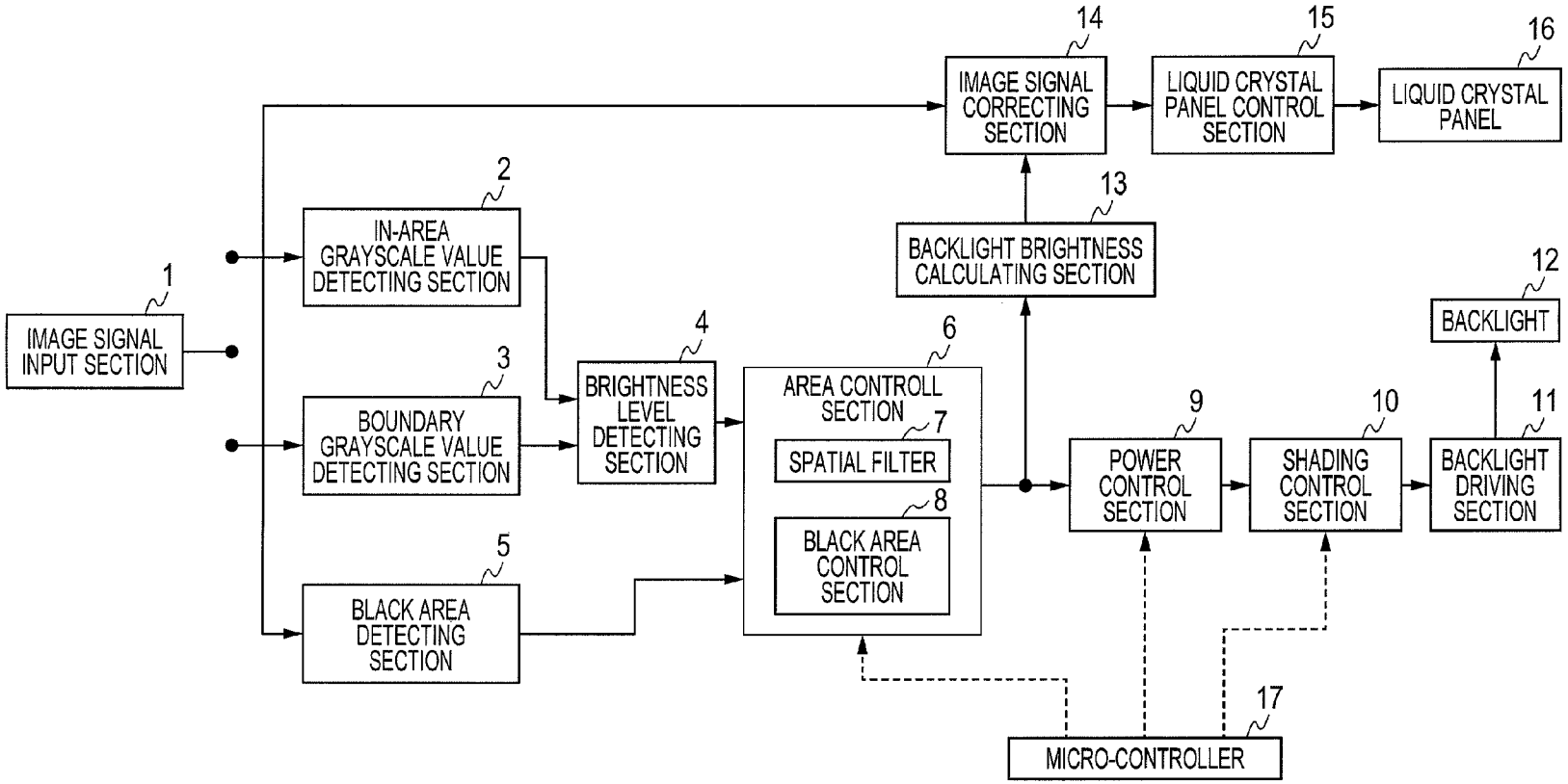
FIG. 1 is a block diagram showing a liquid crystal display device in accordance with an embodiment of the present invention.

Referring now to the drawings, a description will be given in detail of a preferred embodiment in accordance with the present invention.

FIG. 1 is a block diagram showing a liquid crystal display device in accordance with an embodiment of the present invention. The liquid crystal display device includes an image signal input section 1, an in-area grayscale value detecting section 2, a boundary grayscale value detecting section 3, a brightness level detecting section 4 and a black area detecting section 5. Feature values of an image signal inputted to the device are detected by the detecting sections 2-5. A backlight light-control section, for generating a control signal (light control values) for a backlight 12, includes an area control section 6, a spatial filter 7, a black area control section 8, a power control section (APC (Automatic Power Control)) 9 and a shading control section 10. The backlight 12 is driven by a backlight driving section 11.

In order to generate a control signal for a liquid crystal panel 16, the liquid crystal display device includes a backlight brightness calculating section 13 and an image signal correcting section 14. The liquid crystal panel 16 is driven by a liquid crystal panel control section 15. A micro-controller 17, functioning as a controller, controls the operation of each component while controlling the backlight 12 according to an image display mode selected by the user.

The backlight 12 is formed by a plurality of light source blocks (backlight cells) each having an LED light source. The backlight cells can be lit at different (independent) brightness levels (backlight brightness). The control signal (light control values) for the backlight 12 is first set by the area control section 6 according to the brightness level (luminance level) of the inputted image signal and thereafter corrected by the spatial filter 7, the black area control section 8, the power control section 9 and the shading control section 10 according to the selected image display mode.

Figure 2A:
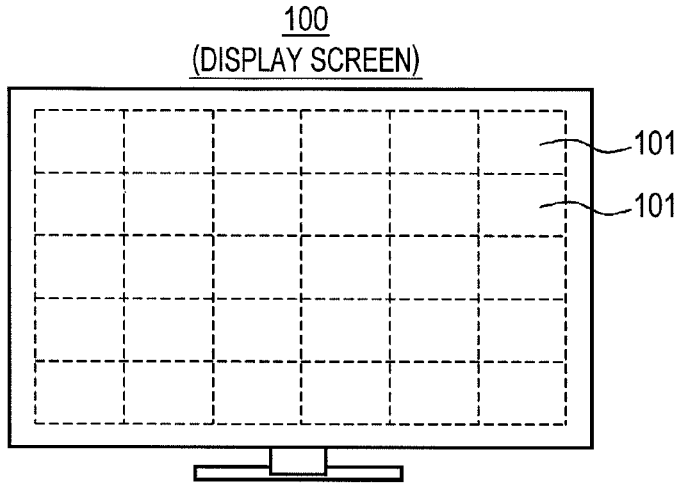
FIG. 2A is a schematic diagram showing an example of the configuration of a liquid crystal panel.
Figure 2B:
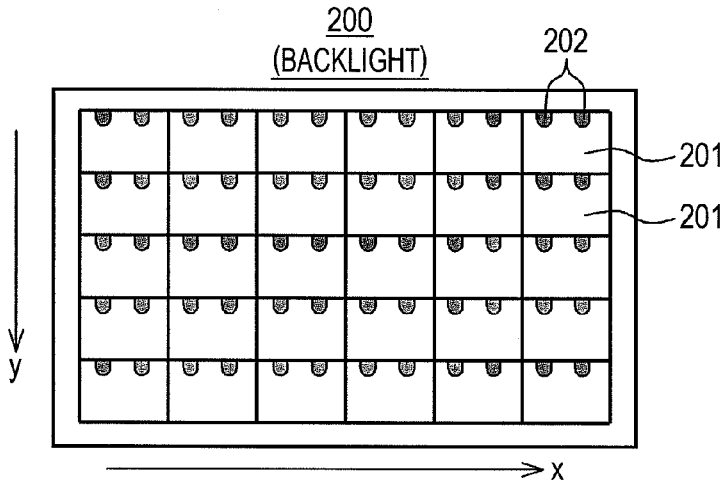
FIG. 2B is a schematic diagram showing an example of the configuration of a backlight.

Next, the configuration and operation of each component of the liquid crystal display device of this embodiment will be explained below. FIGS. 2A and 2B are schematic diagrams showing an example of the configuration of the liquid crystal panel 16 and the backlight 12, respectively. The display screen 100 of the liquid crystal panel 16 is segmented into sub-regions (areas) 101 each including a plurality of pixels. In this example, the display screen 100 is segmented into thirty rectangular areas 101 by dividing it into six parts in the horizontal direction and five parts in the vertical direction.

The illuminating face 200 of the backlight 12 facing the display screen 100 is formed by arranging a plurality of backlight cells 201 in a matrix (six cells in the horizontal direction and five cells in the vertical direction) so that the backlight cells 201 can illuminate corresponding areas 101 of the liquid crystal panel 16 (display screen 100). Each backlight cell 201 is equipped with an LED light source 202 (a pair of LED light sources 202 in this example) arranged in its upper part. Thus, light intensity levels of the backlight cells 201 are controlled independently in units of backlight cells.

Figure 3:
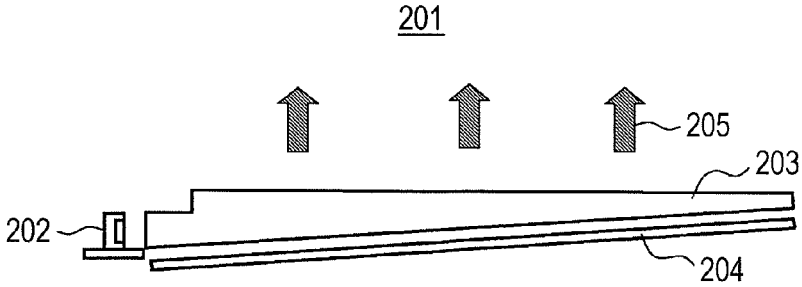
FIG. 3 is a schematic cross-sectional view showing an example of the configuration of a backlight cell of the backlight.

FIG. 3 is a schematic cross-sectional view showing an example of the configuration of the backlight cell 201. In FIG. 3, a cross section taken along a plane parallel to the vertical direction (Y-axis) of the display screen 100 shown in FIG. 2A and orthogonal to the display screen 100 is shown. The backlight cell 201 is equipped with the LED light source(s) 202, a light guide plate 203 and a reflecting plate 204. Light emitted from the LED light source 202 is incident upon an end face (left end in FIG. 3) of the light guide plate 203. The light guide plate 203 outputs the incident light toward the liquid crystal panel 16 (upward in FIG. 3) as indicated with arrows. The light guide plate 203 has a wedge-shaped cross section with its thickness gradually decreasing from the light inlet end to a tip (right end in FIG. 3) opposite to the light inlet end. This shape allows the light guide plate 203 (from the light inlet end to the tip) to output the light upward. The reflecting plate 204 arranged at the back of the light guide plate 203 reflects the incident light (entering and traveling through the light guide plate 203) upward with high efficiency. Incidentally, while an LED of the so-called side view type (emitting light in a direction parallel to its electrode surface) is employed as the LED light source 202 in this embodiment, the LED light source 202 may also be implemented by an LED of the top view type (emitting light in a direction orthogonal to its electrode surface).

Next, control systems for the liquid crystal panel 16 and the backlight 12 will be explained below. The in-area grayscale value detecting section 2 detects the grayscale level of the inputted image signal in regard to every pixel belonging to one area 101 and thereby obtains an in-area maximum grayscale level of the area 101, for each of the areas 101 forming the liquid crystal panel 16 (display screen 100). The boundary grayscale value detecting section 3 detects the grayscale level of the inputted image signal in regard to every pixel belonging to a boundary part of one area 101 (adjoining neighboring areas) and thereby obtains a boundary part maximum grayscale level of the area 101, for each of the areas 101 forming the liquid crystal panel 16 (display screen 100).

The brightness level detecting section 4 detects a maximum brightness level of each area from the values of the in-area maximum grayscale level and the boundary part maximum grayscale level of the area. It is also possible to detect an average brightness level (APL (Average Picture Level)) of each area instead of the maximum brightness level and execute the subsequent process based on the average brightness level. Meanwhile, the black area detecting section 5 compares a brightness signal level (luminance signal level) of each of the pixels in the display screen with a black level threshold value, obtains the number of pixels whose brightness signal level is the threshold value or less, and measures a black display area ("black area") from the ratio of the obtained number of pixels to the total number of pixels in the screen.

The area control section 6 sets illumination intensity of each backlight cell 201 (for each area) based on the maximum brightness level of each area detected by the brightness level detecting section 4 (area control). Specifically, the area control section 6 sets a control value as a backlight driving signal (hereinafter referred to as a "light control value") so that the backlight brightness will be at a level proportional to the maximum brightness level. Further, the area control section 6, including the spatial filter 7 and the black area control section 8, corrects the light control values (for the areas) which has been set as above.

The spatial filter 7 corrects the light control values for the areas so that spatial distribution of the light control values becomes more moderate (spatial filter control) in consideration of the effect of leaking of light between adjoining areas. In other words, the spatial filter 7 changes the intensity of the area control.

The black area control section 8 compares the black area detected by the black area detecting section 5 with a black area threshold value and sets a minimum value (lower limit value) of the light control value based on the comparison. Specifically, when the black area is smaller than the black area threshold value, the light control values of all the areas are set at the maximum (area control: OFF). When the black area is larger than the black area threshold value, the minimum value of the light control values is set corresponding to the black area (black area control). Further, flicker is prevented by use of a time filter (although not shown in FIG. 1). Specifically, when the difference in the light control value between frames exceeds a threshold value, the change (difference) is suppressed by the time filter.

The power control section (APC) 9 occasionally calculates the electric power consumption of the entire backlight and controls the light control values so that the power consumption does not exceed a limit value (threshold value). When the power consumption exceeds the threshold value, the power control section 9 uniformly lowers the light control values of all the areas (power control). The shading control section 10 executes a process of reducing the light control values of backlight cells 201 for the peripheral part of the screen by a prescribed amount (shading control) so as to relatively lower the brightness in the peripheral part of the screen in comparison with the central part of the screen.

The backlight driving section 11 receives the light control value for each area and controls the brightness of each backlight cell 201 (LED light source 202) corresponding to each area. For the brightness adjustment of the LED light source 202, PWM (Pulse-Width Modulation) and amplitude control may be used. In the PWM control, the duty ratio is set so that it reaches 100% when the brightness is at the maximum. The duty ratio is varied corresponding to the light control value.

The backlight brightness calculating section 13 calculates backlight brightness on the display screen based on the light control values for the areas outputted by the area control section 6. The backlight brightness at an arbitrary point A on the screen is obtained by first figuring out the brightness value at the point A in each case where only one backlight cell 201 for each area is lit at the light control value for the area and then calculating the sum of the brightness values of all the cases (total brightness when all the backlight cells 201 are lit).

The image signal correcting section 14 corrects the image signal (grayscale value) for each pixel based on the backlight brightness B calculated by the backlight brightness calculating section 13. This correction is made by multiplying the image signal (grayscale value) by a correction coefficient Bmax/B, where "Bmax" represents the backlight brightness when the backlight cells of all the areas are lit at the maximum light control value.

The liquid crystal panel control section 15 generates a display control signal based on the corrected image signal and horizontal and vertical synchronization signals inputted thereto. A display signal and a scan signal (as the display control signal) are outputted to the liquid crystal panel 16 from an H-driver and a V-driver of the liquid crystal panel control section 15, respectively. The liquid crystal panel 16 receiving the display signal and the scan signal applies a grayscale voltage corresponding to the display signal to each corresponding pixel area and thereby controls the liquid crystal optical transmittance in each pixel area.

Incidentally, detailed operation of the spatial filter 7, the black area control section 8, the power control section 9 and the shading control section 10 for correcting the backlight control values (light control value) will be described later.

Figure 4:
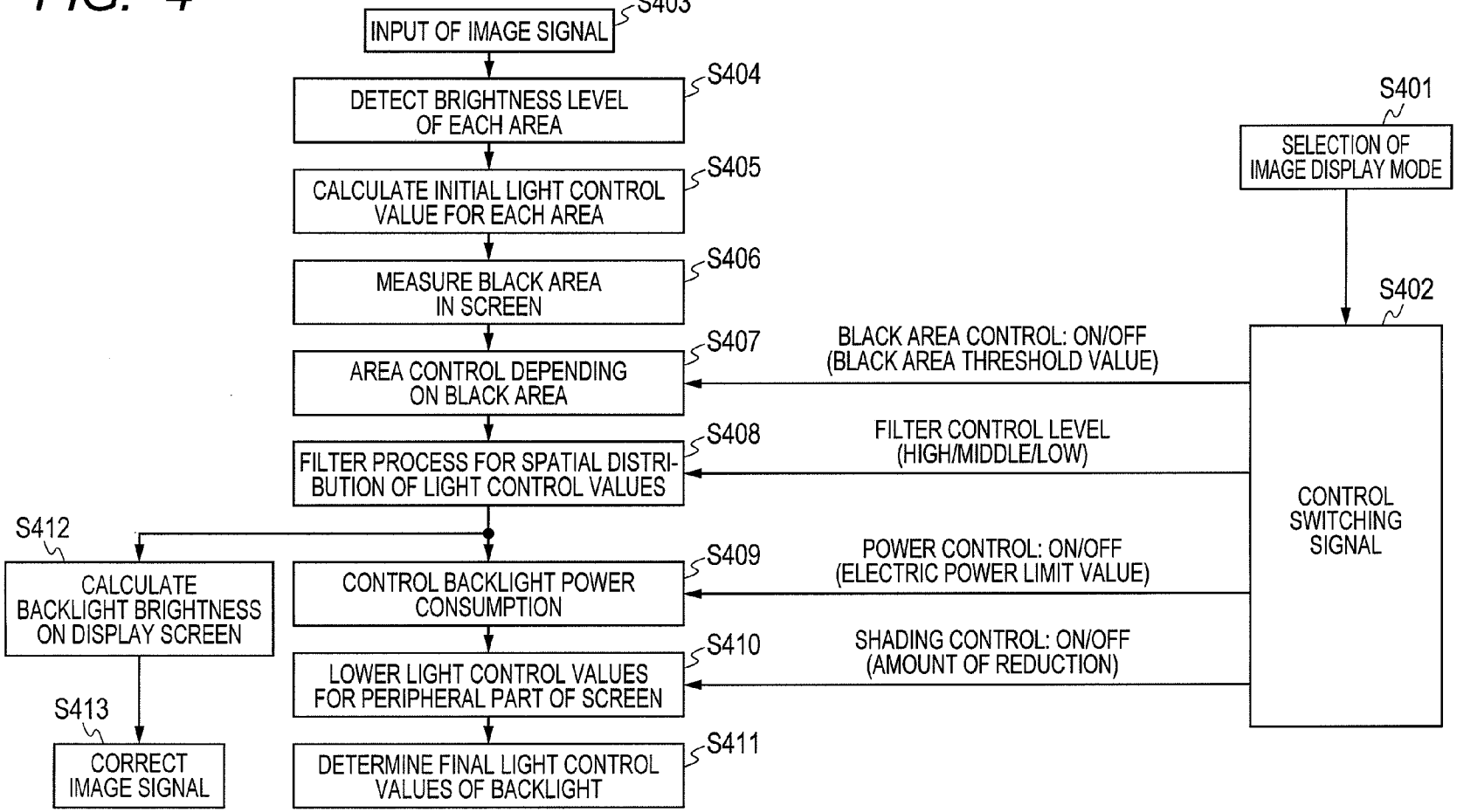
FIG. 4 is a flow chart showing the process flow of backlight control.

FIG. 4 is a flow chart showing the process flow of the backlight control in this embodiment. In step S401, the micro-controller 17 receives the user's selection of the image display mode. In step S402, the micro-controller 17 sends a control switching signal corresponding to the selected image display mode to each processing section for the backlight control. Selectable image display modes may include an "in-store demonstration (supermarket) mode", a "power reduction (standard) mode", a "high image quality (cinema) mode", etc.

In step S403, the image signal is inputted to the image signal input section 1. Thereafter, the following process is executed for each frame. In step S404, the brightness level detecting section 4 detects the maximum brightness level of each area. As mentioned above, it is also possible to detect an average brightness level (APL (Average Picture Level)) of each area instead of the maximum brightness level and execute the following process based on the average brightness level.

In step S405, the area control section 6 calculates the light control value (backlight control value) for each area (hereinafter referred to as an "initial light control value"). The initial light control values for the areas are determined so that the backlight brightness of each area becomes proportional to the maximum brightness level of the area. In step S406, the black area detecting section 5 compares the brightness signal level (luminance signal level) of each of the pixels in the screen with the black level threshold value (in regard to the whole of the inputted screen image (one frame)) and measures the ratio of the black area to the entire screen (%) based on the number of pixels whose brightness signal level is the threshold value or less.

In step S407, the black area control section 8 compares the black area detected by the black area detecting section 5 with the black area threshold value and sets the minimum value (lower limit value) of the light control value based on the comparison. When the black area is smaller than the black area threshold value, the light control values of all the areas are set at the maximum (area control: OFF). When the black area is larger than the black area threshold value, the minimum value of the light control values is set corresponding to the black area (black area control). This black area control (S407) is executed according to the control switching signal supplied from the micro-controller 17 in the step S402. According to the control switching signal, whether the black area control (step S407) should be executed or not (ON/OFF) is switched and the black area threshold value (when the black area control is executed) is set. In cases where the black area control is OFF, the step S407 is skipped.

In step S408, the spatial filter 7 corrects the light control values of the areas so that spatial distribution of the light control values becomes more gradual between areas (spatial filter control). This spatial filter control (S408) is also executed according to the control switching signal supplied in S402. According to the control switching signal, the control level (HIGH/MIDDLE/LOW) of the spatial filter (S408) is switched. Incidentally, the control level "HIGH (STRONG)" means to make (leave) the spatial distribution of the light control values sharp, while "LOW (WEAK)" means to moderate the spatial distribution of the light control values.

In step S409, the power control section 9 occasionally calculates the power consumption of the entire backlight and controls the light control values so that the power consumption does not exceed the limit value (threshold value). When the power consumption exceeds the threshold value, the power control section 9 uniformly lowers the light control values of all the areas (power control). This power control (S409) is also executed according to the control switching signal supplied in S402. According to the control switching signal, whether the power control (S409) should be executed or not (ON/OFF) is switched and the limit value (when the power control is executed) is set. In cases where the power control is OFF, the step S409 is skipped.

In step S410, the shading control section 10 reduces the light control values of the backlight cells for the peripheral part of the screen by a prescribed amount in comparison with the central part of the screen (shading control). This shading control (S410) is also executed according to the control switching signal supplied in S402. According to the control switching signal, whether the shading control (S410) should be executed or not (ON/OFF) is switched and the amount of reduction of the light control values (when the shading control is executed) is set. In cases where the shading control is OFF, the step S410 is skipped.

In step S411, final light control values for the areas of the backlight are determined. The backlight is driven according to the final light control values.

Meanwhile, in step S412, the backlight brightness calculating section 13 calculates the backlight brightness on the display screen based on the light control values of the areas after undergoing the spatial filter control of S408. In step S413, the image signal correcting section 14 corrects the image signal (grayscale value) of each pixel based on the backlight brightness calculated in S412. The corrected image signal is used for generating the display signal (display control signal) for the liquid crystal panel 16.

FIG. 5 is a table showing the relationship between the image display mode and the backlight control. Examples of combinations of backlight control functions that should be executed for each image display mode selected by the user are shown in FIG. 5. In this example, the user is allowed to select a desired image display mode from three options: (a) in-store demonstration (supermarket) mode, (b) power reduction (standard) mode and (c) high image quality (cinema) mode. Meanwhile, the backlight control functions include (1) spatial filter control, (2) black area control, (3) power control and (4) shading control. The switching (ON/OFF, HIGH/MIDDLE/LOW) of each backlight control function is executed in conjunction with the selection of the image display mode by the user. The threshold value, limit value, etc. used in the control functions can be selected by the user.

Concrete examples of the switching of the control will be explained below. In the in-store demonstration mode (a), it is desirable to maximize the brightness of the display screen since the illuminance of the surrounding environment is high. Therefore, the power control and the shading control are set to OFF. Incidentally, it is also possible to set the shading control to ON while increasing the backlight power consumption in the in-store demonstration mode. In the power reduction mode (b), high priority is given to the reduction of power consumption. Therefore, the power control and the shading control are set to ON while setting the black area control to OFF. In this mode, the user is allowed to select the threshold value, etc. of the power control and the shading control (i.e., the amount of electric power saving). In the high image quality mode (c), high priority is given to the image quality such as the brightness and the contrast of the display screen. Therefore, it is effective to suppress the so-called "black floating" (phenomenon (graying of black) specific to liquid crystal displays) by setting the spatial filter control at HIGH (or MIDDLE) (see the definition of "HIGH" given in the explanation of the step S408 of FIG. 4).

By the control described above, each backlight control function is optimized according to the image display mode selected by the user, realizing image display suitable for the purpose of the display. Incidentally, the combinations of control functions shown in FIG. 5 are just an example for illustration. The conditions for the control may be changed according to the viewing environment, etc. While the above image display modes selectable by the user have been explained as an example, it is also possible to add an illuminance sensor to the liquid crystal display device and make the device automatically control the backlight according to the surrounding environment (illuminance). For example, when the surrounding environment (e.g., illumination in the room in which the liquid crystal display device is placed) is bright, the power control and the shading control may be automatically set to OFF so as to keep the displayed images bright and easy to see. When the surrounding environment is dark, the power control and the shading control may be automatically set to ON since the need of keeping the images bright is lower compared to the cases where the surrounding environment is bright.

As above, by this embodiment in which the mode of the area control executed by the backlight light-control section is switched and controlled according to the instruction by the user and/or the surrounding environment, the power consumption of the backlight can be reduced while realizing the displaying of high quality images.

In the following, the spatial filter control, the black area control, the power control and the shading control, which have been taken as examples of the backlight control functions, will be explained in more detail.

FIGS. 6A-6D are explanatory drawings for explaining the operation of the spatial filter 7. First, distribution of the light emitted from the backlight (backlight cell) will be explained. While the light emitted from a backlight cell basically illuminates the area corresponding to the backlight cell, not 100% of the light illuminates the corresponding area, that is, some of the emitted light leaks out to adjacent areas due to the structure of the backlight. For example, 80% of the light emitted from a backlight cell (at the center) illuminates the corresponding area and the remaining 20% leaks out to adjacent areas (upward, downward, rightward and leftward) as in the screen 600*a* shown in FIG. 6A. When all the backlight cells are lit at the maximum brightness, each area (evenly exchanging the leaking light with each adjacent area) is capable of maintaining its brightness at 100%. However, in the area control in which the backlight cell brightness differs among the areas, the brightness of an image (symbol, figure, etc.) displayed on the screen is affected by areas surrounding the image.

Figure 6A:
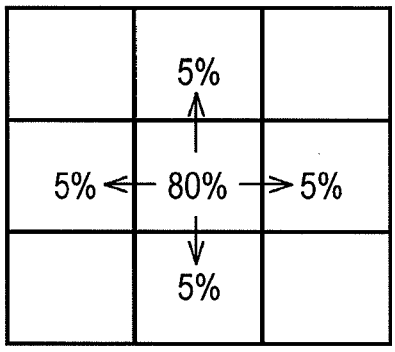
FIGS. 6A-6D are explanatory drawings for explaining the operation of a spatial filter.
Figure 6B:
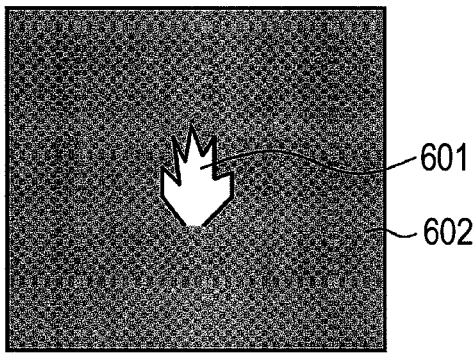
Figure 6C:
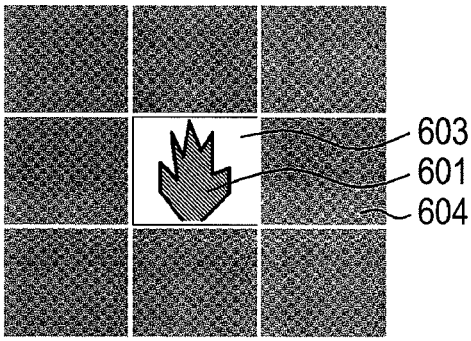
Figure 6D:
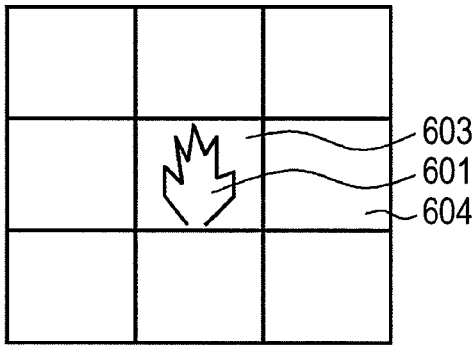
Figure 7A:
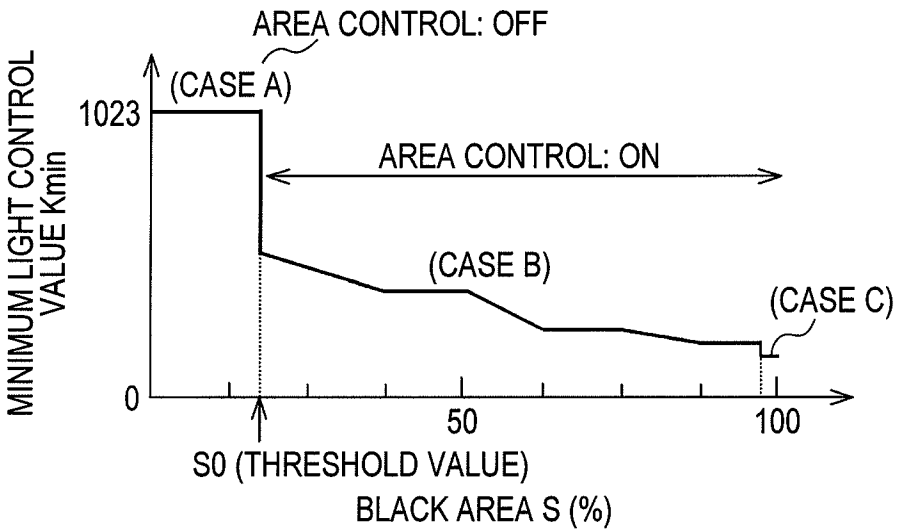
FIGS. 7A-7D are graphs for explaining the operation of a black area control section.
Figure 7B:
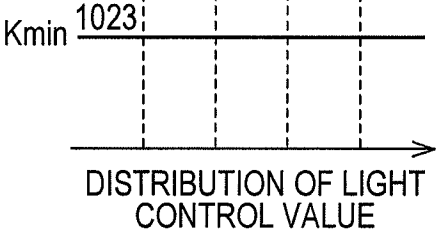
Figure 7C:
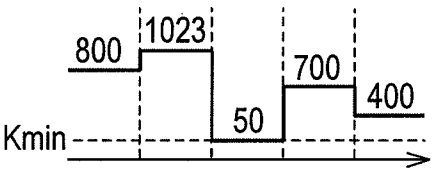
Figure 7D:
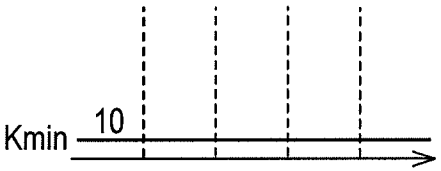

For example, in a case where a bright image 601 exists at the center of a dark background image 602 as in the screen 600*b* shown in FIG. 6B, executing ordinary area control to the backlight results in the screen 600*c* shown in FIG. 6C. In the central area 603, the backlight brightness is set high according to the bright image 601 while setting the backlight brightness low for the surrounding areas 604. Consequently, the amount of light leaking from the surrounding areas 604 to the central area 603 decreases and the image 601 in the central area 603 gets darker than its original brightness.

The spatial filter 7 is used as a countermeasure against this phenomenon. In the screen 600*d* shown in FIG. 6D, the backlight brightness for the surrounding areas 604 is also increased equivalently to the central area 603. Consequently, the amount of light leaking from the surrounding areas 604 to the central area 603 increases, by which the brightness of the image 601 in the central area 603 can be made close to the original brightness. The spatial filter 7 executes this process. Specifically, the spatial filter 7 adds up the amounts of the light leak from the surrounding areas to the area by use of area coefficients (representing the amount of the light leak between adjoining areas) and thereby corrects the light control values so that the backlight brightness of the area equals a desired value. In other words, the spatial filter 7 executes a process of moderating the brightness difference between adjoining areas to the backlight brightness distribution among the areas. The control level of the spatial filter 7 can be selected from and switched among the aforementioned three levels STRONG, MIDDLE and WEAK (HIGH, MIDDLE and LOW). The screen 600*c* (FIG. 6C) represents a case where the control level is "STRONG", while the screen 600*d* (FIG. 6D) represents a case where the control level is "WEAK" (see the definition of the control levels given in the explanation of the step S408 of FIG. 4).

FIGS. 7A-7D are graphs for explaining the operation of the black, area control section 8. The black area control section 8 controls the intensity of the area control according to the black area detected by the black area detecting section 5. Specifically, the black area control section 8 compares the black area S with the black area threshold value S0 and sets the lower limit of the light control value (minimum light control value Kmin) of the backlight based on the comparison. If the black area S is less than the black area threshold value S0, the maximum value permissible for the light control value is given as the minimum light control value Kmin (case A). If the black area S is the threshold value S0 or more, an intermediate light control value previously set corresponding to the black area S is given as the minimum light control value Kmin (case B). If the black area S corresponds to the entire screen (approximately 100%), a light control value for "all black" is given as the minimum light control value Kmin (case C). Incidentally, the black area threshold value S0 and the intermediate light control value used in the case B may be changed (switched) in conjunction with the selection of the image display mode by the user.

By the above setting of the minimum light control value Kmin, when the black area is small as in the case A, the light control values of all the areas area set at the maximum light control value (maximum value of the backlight brightness) (area control: OFF), by which the image is displayed with the original brightness. In contrast, when the black area increases as in the case B and case C, electric power reduction can be achieved by intensifying the area control by lowering the minimum light control value Kmin.

Figure 8:
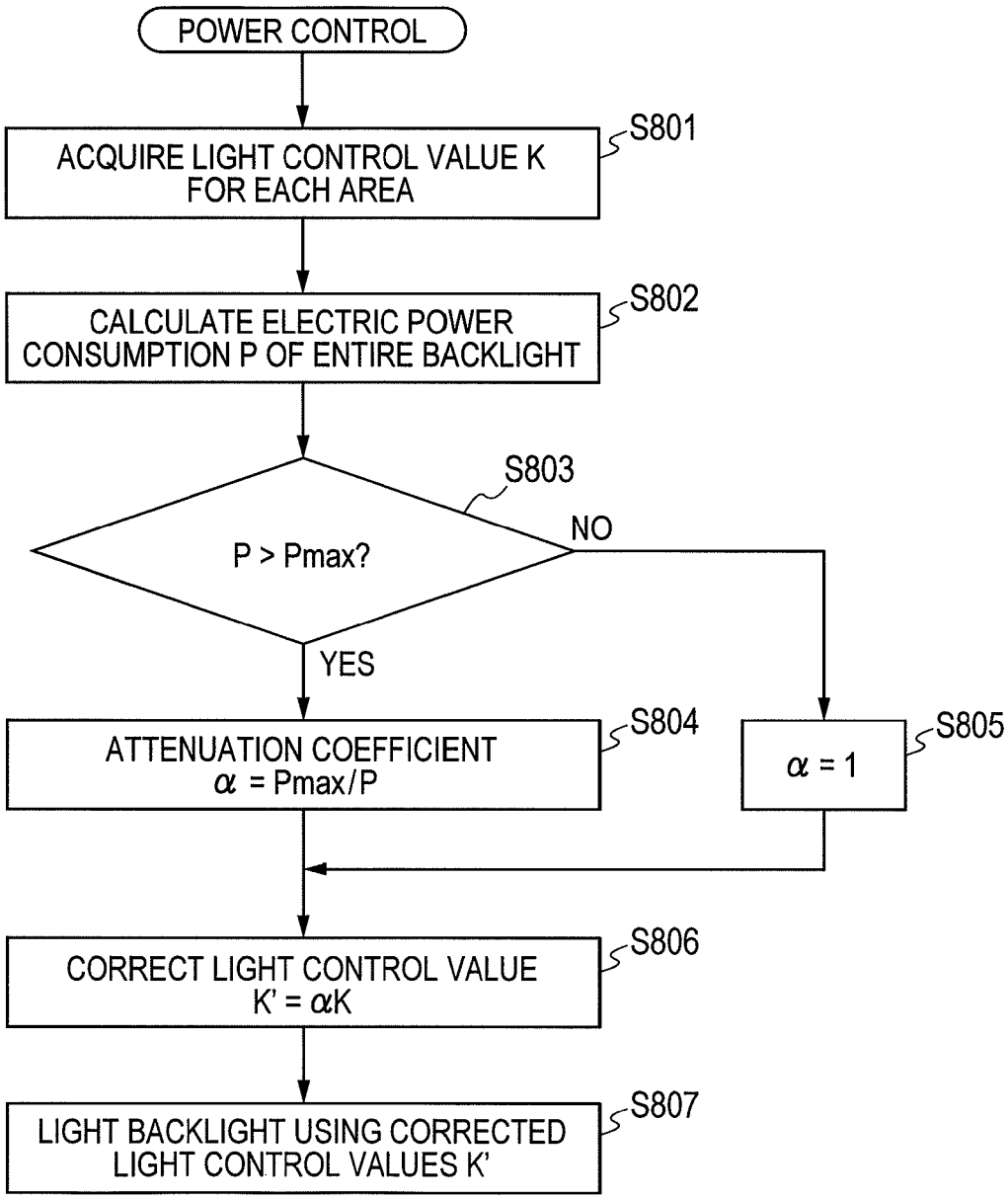
FIG. 8 is a flow chart showing the operation of a power control section.

FIG. 8 is a flow chart showing the operation of the power control section 9. The power control section 9 calculates the power consumption of the entire backlight and controls the light control values so that the power consumption does not exceed the limit value. In step S801, the light control value K of each backlight cell (light source block) for each area is acquired. In step S802, the electric power P consumed by the entire backlight is calculated. In cases where the power consumption of each light source block is proportional to its light control value, the power consumption P of the entire backlight can be calculated by adding up the light control values K of all the light source blocks. Even when the proportionality does not hold between the power consumption and the light control value of each light source block, the power consumption P of the entire backlight can be calculated by first calculating the power consumption of each light source block using a relational expression between the power consumption and the light control value and then summing up the calculated power consumptions.

In step S803, the calculated power consumption P is compared with the limit value (threshold value) Pmax. When the power consumption P exceeds the threshold value Pmax (S803: YES), the process advances to step S804 and an attenuation coefficient $\alpha$ for the light control value K is obtained (e.g., $\alpha$=Pmax/P). When the power consumption P is the threshold value Pmax or less (S803: NO), the process advances to step S805 and the attenuation coefficient $\alpha$ is set at 1 ($\alpha$=1).

In step S806, the light control value K for each area is corrected by uniformly multiplying the light control value K by the attenuation coefficient $\alpha$ (corrected light control value K'=$\alpha$K). In step S807, the backlight is lit using the corrected light control values K' for the areas (using the original light control values K when the power consumption P is the threshold value Pmax or less). By this process, the power consumption of the backlight can be limited within the threshold value Pmax.

By repeatedly executing the above process as needed (for each frame, for example) the power consumption can be kept within the threshold value Pmax even when the input image changes abruptly. Incidentally, the threshold value Pmax may be set variably according to the intended amount of electric power saving.

Figure 9A:
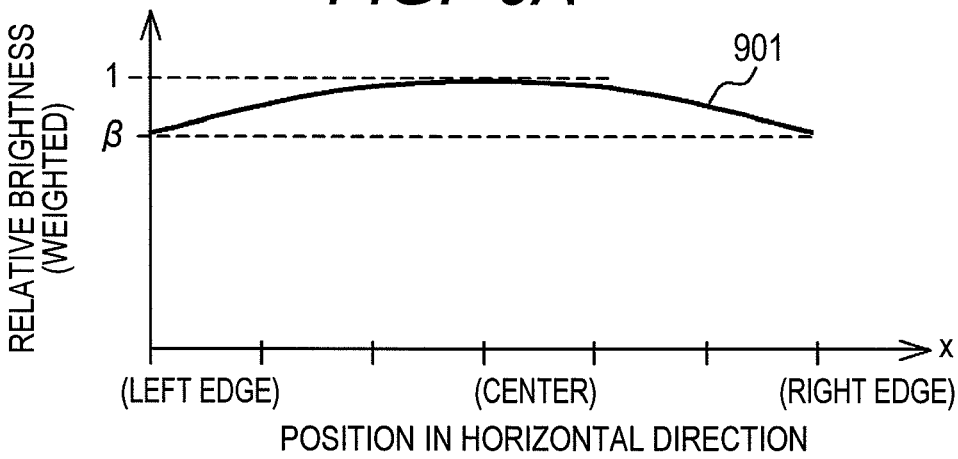
FIGS. 9A and 9B are graphs showing the operation of a shading control section.
Figure 9B:
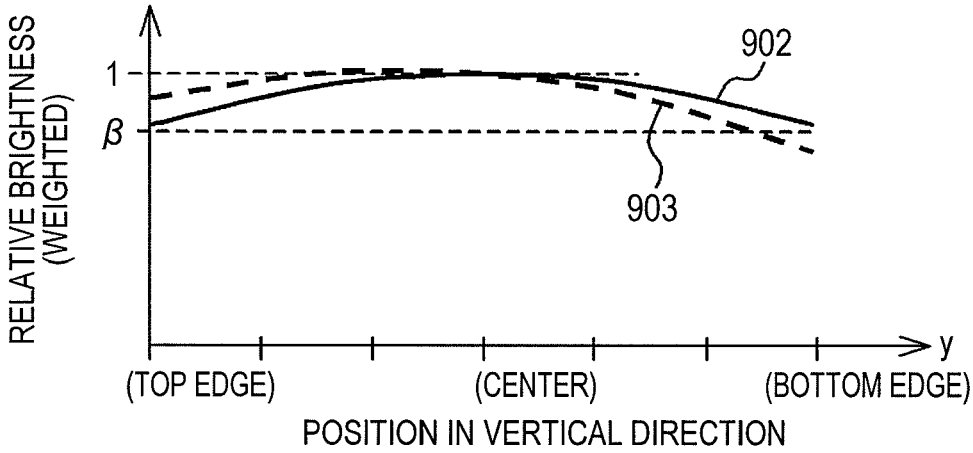

FIGS. 9A and 9B are graphs showing the operation of the shading control section 10. In FIGS. 9A and 9B, distribution of the brightness on the display screen after the shading process is shown, wherein the reference numeral "901" (FIG. 9A) represents the brightness distribution in the horizontal direction (X direction) of the screen and "902" (FIG. 9B) represents the brightness distribution in the vertical direction (Y direction) of the screen. In either direction, the correction (shading process) is made so that the brightness in the peripheral part of the screen (right and left edges, top and bottom edges) becomes relatively lower than that in the central part of the screen. The shading process has the effects of enhancing the presence of displayed images adapting to visual properties of the human (placing his/her effective visual field in the central part of the screen) and reducing the electric power (power consumption). This process may be conducted by making a weighting correction to the backlight brightness distribution (distribution of the light control values) obtained by the area control so as to reduce the relative brightness of the peripheral part of the screen to β(<1 on the assumption that the relative brightness equals 1 in the central part). Since the power consumption of the backlight is reduced by the execution of the shading control, the intensity of the shading (β) can be represented by the amount of reduction of the power consumption.

Incidentally, when the backlight cell 201 of the edge light type shown in FIG. 3 is employed for the backlight, the brightness distribution of the light emitted from the backlight cell 201 becomes asymmetrical depending on the position of the LED light source(s) 202 in the backlight cell (darker on the LED light source's side). Consequently, in the case where the backlight cells 201 are arranged as shown in FIG. 2B, the brightness distribution becomes asymmetrical in the vertical direction of the screen even when all the backlight cells 201 are lit at the same brightness (darker in the upper part of the screen). Therefore, by making a correction to the aforementioned weighting correction in the vertical direction (Y direction) of the screen as indicated with the reference numeral "903" (broken line) so as to eliminate the asymmetry, symmetry of the brightness distribution in the vertical direction can be achieved. In the arrangement shown in FIG. 2B, the weighting correction in the horizontal direction (X direction) of the screen (indicated with the reference numeral "901" (solid line)) needs no further correction since the brightness distribution in the horizontal direction is symmetrical from the outset.

As described above, by the configuration of the above embodiment, each backlight control function is optimized according to the image display mode selected by the user, realizing image display suitable for the purpose of the display. Incidentally, while the spatial filter control, the black area control, the power control and the shading control have been taken as examples of the backlight control functions in the above description, the combination of the backlight control functions is just a specific example. The combination may be changed properly according to the viewing environment, etc.

While the backlight light-control section (including the area control section 6, spatial filter 7, black area control section 8, power control section 9 and shading control section 10) and the micro-controller 17 (as the controller for controlling the backlight light-control section) are implemented as separate circuit elements in the above embodiment, it is also possible to integrate the backlight light-control section and the micro-controller 17 (and the detecting sections 2, 3 and 5) into one integrated circuit.

What is claimed is:

1. A liquid crystal display device comprising a liquid crystal panel and a backlight which illuminates the liquid crystal panel with light, wherein:

the liquid crystal panel is segmented into a plurality of areas of pixels by dividing the pixels on the panel into a plurality of pixel groups, and the backlight is formed by a plurality of backlight cells corresponding to the areas, respectively, and the liquid crystal display device comprises:

an area control section which individually sets a light control value for controlling illumination intensity of each backlight cell, based on a brightness level of an image signal for the area corresponding to the backlight cell;

light control value correcting sections which corrects the light control values set by the area control section; and a controller which controls operations of the area control section and the light control value correcting sections, wherein:

the light control value correcting sections include:

a black area control section which measures a black area based on the number of pixels whose brightness signal level is a black level threshold value or less, compares the calculated black area with a black area threshold value, and sets a minimum value of the light control value based on result of the comparison, and which sets maximum values of the light control values of all the areas in a case where the black area is less than the black area threshold value, a power control section which calculates power consumption of the backlight and corrects the light control values so that the power consumption does not exceed an electric power limit value, and a shading control section which corrects the light control values so as to relatively lower brightness in a peripheral part of a screen of the liquid crystal panel in comparison with a central part of the screen, the controller controls the illumination by the backlight by switching the operations of the light control value correcting sections according to one of image display modes which has been selected by a user, the image display modes include a first image display mode in which an image is able to be displayed at highest brightness, a second image display mode which is lower in power consumption than the first image display mode, and a third image display mode in which an image is able to be displayed at higher brightness and with higher contrast, when the first image display mode has been selected, the controller controls the black area control section and the power control section so that the black area control section is ON and the power control section is OFF, when the second image display mode has been selected, the controller controls the black area control section, the power control section, and the shading control section so that the black area control section is OFF and the power control section and the shading control section are ON, and when the third image display mode has been selected, the controller controls the black area control section, the power control section, and the shading control section so that the black area control section is ON and the power control section and the shading control section are OFF.

2. The liquid crystal display device according to claim 1, wherein: the light control value correcting sections further include:

a spatial filter which corrects the light control values so that spatial distribution of the light control values becomes more moderate in consideration of effect of leaking of light between adjoining areas;

wherein, when the first or second image display mode has been selected, the controller sets the spatial filter at a low level, and, when the third image display mode has been selected, the controller sets the spatial filter at a higher level than the level at which the controller sets the spatial filter when the first or second image display mode has been selected.

3. The liquid crystal display device according to claim 2, wherein the controller sets the black area threshold value of the black area control section, the electric power limit value of the power control section or a power reduction value of the shading control section according to selection by the user.

4. The liquid crystal display device according to claim 1, wherein the first image display mode is an in-store demonstration mode.

5. The liquid crystal display device according to claim 1, further comprising an illuminance sensor which detects illuminance around the device, wherein the controller controls the illumination by the backlight by switching the operations of the light control value correcting sections according to the illuminance detected by the illuminance sensor.

* * * * *